US009089782B2

(12) United States Patent
Achan, Jr.

(10) Patent No.: US 9,089,782 B2
(45) **Date of Patent: *Jul. 28, 2015**

(54) SMART STUFFED TOY WITH AIR FLOW VENTILATION SYSTEM

(71) Applicant: LCAIP, LLC, Bellmore, NY (US)

(72) Inventor: Leonard Achan, Jr., Bellmore, NY (US)

(73) Assignee: LCAIP, LLC., Bellmore, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/457,685

(22) Filed: Aug. 12, 2014

(65) Prior Publication Data

US 2014/0357150 A1 Dec. 4, 2014

Related U.S. Application Data

(63) Continuation-in-part of application No. 13/856,417, filed on Apr. 3, 2013, now Pat. No. 8,801,490, which is a continuation-in-part of application No. 13/336,839, filed on Dec. 23, 2011, now Pat. No. 8,414,347.

(60) Provisional application No. 61/427,104, filed on Dec. 23, 2010.

(51) Int. Cl.
*A63H 3/02* (2006.01)
*A63H 3/00* (2006.01)

(52) U.S. Cl.
CPC ..... *A63H 3/02* (2013.01); *A63H 3/003* (2013.01); *A63H 3/001* (2013.01); *A63H 3/006* (2013.01); *A63H 2200/00* (2013.01)

(58) Field of Classification Search
USPC ..... 5/423; 297/188.14; 446/72
See application file for complete search history.

(56) References Cited

U.S. PATENT DOCUMENTS

| | | | | |
|---|---|---|---|---|
| 5,317,767 | A | 6/1994 | Hargest et al. | |
| 6,325,084 | B1 | 12/2001 | Cohen | |
| 6,843,655 | B1 | 1/2005 | Duprey | |
| 6,887,120 | B2 | 5/2005 | Shamitoff | |
| 7,241,196 | B1 | 7/2007 | Niklibore | |
| 7,360,772 | B2 | 4/2008 | Koch | |
| 7,488,231 | B2 | 2/2009 | Weston | |
| 7,695,063 | B2 | 4/2010 | Hagler-Gray et al. | |
| 2002/0094746 | A1 | 7/2002 | Harlev | |
| 2002/0111132 | A1 * | 8/2002 | Meneely, Jr. | 454/343 |
| 2006/0166597 | A1 | 7/2006 | Dhillon | |
| 2006/0222560 | A1 * | 10/2006 | Stanley, III | 422/5 |
| 2006/0234602 | A1 * | 10/2006 | Palmquist | 446/297 |

(Continued)

FOREIGN PATENT DOCUMENTS

| | | | |
|---|---|---|---|
| WO | 2010/021592 | A1 | 2/2010 |
| WO | WO 2010086595 | A2 * | 8/2010 |

*Primary Examiner* — Tramar Harper
(74) *Attorney, Agent, or Firm* — IM IP Law PLLC; C. Andrew Im

(57) ABSTRACT

A smart stuffed toy with at least one sensor for determining an atmospheric environment within the immediate proximity of the smart stuffed toy, a control unit and an air flow ventilation device embedded within the smart stuffed toy to provide air circulation and reduce the settlement of carbon dioxide. The air flow ventilation device comprises no blades or safe fan blades. The control unit controls the air flow ventilation device based on the sensor reading. Preferably, the front surface covering the air flow ventilation device is made of material different from the remaining surfaces of the smart stuffed toy.

20 Claims, 5 Drawing Sheets

(56) References Cited

U.S. PATENT DOCUMENTS

2008/0242191 A1* 10/2008 Chernick et al. ..... 446/242
2010/0003888 A1 1/2010 Massaro
2010/0093251 A1 4/2010 Viniotis
2010/0107338 A1* 5/2010 Waters et al. ..... 5/502
2010/0125949 A1* 5/2010 Stebbing ..... 5/423

* cited by examiner

SMART STUFFED TOY WITH AIR FLOW VENTILATION SYSTEM

RELATED APPLICATION

This application is a continuation-in-part application of U.S. application Ser. No. 13/856,417 filed Apr. 3, 2013, which is a continuation-in-part application of U.S. application Ser. No. 13/336,839 filed Dec. 23, 2011, now U.S. Pat. No. 8,414,347, which claims the benefit of U.S. Provisional Application No. 61/427,104 filed on Dec. 23, 2010, each of which is incorporated herein by reference in its entirety.

TECHNICAL FIELD OF THE INVENTION

The claimed invention relates to a smart stuffed toy that provides air circulation and consoles a child. More particularly, the claimed invention relates to a smart stuffed toy with air circulation or air flow ventilation system that provides critical air circulation within immediate proximity of a sleeping infant or child.

BACKGROUND OF THE INVENTION

When preparing a nursery in a home for a new baby's arrival, typically a fan is not high on the list of necessities. But, recent studies have indicated that an addition of a fan may help prevent sudden infant death syndrome (SIDS), the number one killer of infants from one month to one year old. Researchers believe that fans may help to circulate fresh air and prevent babies from suffocating by re-breathing exhaled carbon dioxide or circulating toxins in the air surrounding a cribs mattress.

However, currently available fans may do more harm than good. Commercially available fans are designed to cool a large area or entire room and use of such fans to circulate fresh air to prevent SIDS may overcool the infant, thereby adversely impacting the baby's health. Moreover, the noise from commercially available fans may disturb the sleeping infant or child. Further, these commercially available fans have sharp fan blades rotating at high speed, so they cannot be located within immediate proximity of the sleeping baby, such as within a baby's crib, because they are too dangerous. These sharp fan blades can potentially cut or injure the baby's limbs, toes and fingers. In summary, these commercially fans are too powerful, too loud and too menacing to a baby, and too dangerous to locate within close proximity of the baby.

Accordingly, the claimed invention proceeds upon a desirability of providing a low volume, low oscillating, safe fan that not only comforts the baby but safely provides air circulation within immediate proximity of the baby without endangering the baby with sharp fan blades that can potentially cut or injure the baby's fingers and toes. Teddy bears and similar stuffed toys have been used to comfort and console infants and children for generations. Nurseries are typically filled with various teddy bears and other stuffed toys. The claimed smart stuffed toy with air flow ventilation system can be located within close proximity of an infant or child, e.g., within a crib, near a car seat, etc., to safely provide critical air circulation within immediate proximity of an infant or child, such as circulating fresh air across a mattress of a crib.

SUMMARY OF THE INVENTION

Therefore, an object of the claimed invention is to provide a smart stuffed toy that provides air circulation or air flow ventilation.

Another object of the claimed invention is to provide the aforesaid smart stuffed toy with a fan comprising no blades or safe fan blades made of soft material.

A still another object of the claimed invention is to provide the aforesaid smart stuffed toy with a carbon monoxide detector or a carbon dioxide detector.

The claimed smart stuffed toy comprises an air circulation or air flow ventilation device, such as a fan having no blades or safe fan blades. The air circulation or air flow ventilation device is embedded within the smart stuffed toy. The air circulation or air flow ventilation device comprises a battery casing for housing one or more batteries (rechargeable or non-rechargeable) and the battery casing is accessible via a slit formed on a rear surface of the smart stuffed toy. In accordance with an aspect of the claimed invention, the air circulation or air flow ventilation device can comprise a micro-controller or control unit, fan speed buttons or selection dial, and a timer selection dial, thereby enabling the operator or micro-controller to program or adjust fan's speed and duration. In accordance with an exemplary embodiment of the claimed invention, the front surface covering the air circulation device, preferably the fan blades, is made of material different from the remaining surfaces of the smart stuffed toy. Preferably, the smart stuff toy is made of hypoallergenic and/or fire-retardant material and the front surface is made of foam or air permeable material. The front surface can be also made of rubber, plastic or polyvinyl chloride (PVC) with slits/holes or other suitable material to cover the fan or fan blades and provide air flow from the fan embedded within the smart stuffed toy.

In accordance with an exemplary embodiment of the claimed invention, a smart stuffed toy comprises an air flow ventilation device, at least one sensor and a control unit. The air flow ventilation device is embedded within the smart stuffed toy and provides air circulation through a front surface of the smart stuffed toy covering the air flow ventilation device. The sensor determines an atmospheric environment within an immediate proximity of the smart stuffed toy. The control unit controls the air flow ventilation device based on a sensor reading received from the sensor. The front surface covering the ventilation device is made of material different from remaining surfaces of the smart stuffed toy to permit the air to flow from the ventilation device and through the front surface.

In accordance with an exemplary embodiment of the claimed invention, the aforesaid front surface of the smart stuffed toy covering the air flow ventilation device is made of air permeable material.

In accordance with an exemplary embodiment of the claimed invention, the aforesaid front surface of the smart stuffed toy covering the air flow ventilation device is made of plastic, PVC or rubber with slits or holes to permit air to flow through the front surface.

In accordance with an exemplary embodiment of the claimed invention, the aforesaid air flow ventilation device comprises no blades to safely locate the smart stuffed toy within immediate proximity of an infant or child.

In accordance with an exemplary embodiment of the claimed invention, the aforesaid air flow ventilation device comprises safe fan blades to safely locate the smart stuffed toy within immediate proximity of an infant or child.

In accordance with an exemplary embodiment of the claimed invention, the aforesaid control unit turns on the air flow ventilation device when the sensor reading exceeds a predetermined threshold.

In accordance with an exemplary embodiment of the claimed invention, the aforesaid control unit turns off the air flow ventilation device when the sensor reading is less than a predetermined threshold.

In accordance with an exemplary embodiment of the claimed invention, the aforesaid control unit generates an alarm when the sensor reading exceeds a predetermined threshold.

In accordance with an exemplary embodiment of the claimed invention, the aforesaid control unit transmits the sensor reading and an alarm alert to a client device associated with a user of the smart stuffed toy over a communications network.

In accordance with an exemplary embodiment of the claimed invention, the aforesaid control unit controls a speed of the air flow ventilation device in accordance with the sensor reading.

In accordance with an exemplary embodiment of the claimed invention, the aforesaid control unit increases the speed of the air flow ventilation device when the sensor reading exceeds a predetermined threshold.

In accordance with an exemplary embodiment of the claimed invention, the aforesaid control unit decreases the speed of the air flow ventilation device when the sensor reading is below a predetermined threshold.

In accordance with an exemplary embodiment of the claimed invention, the aforesaid smart stuffed toy further comprises a video camera for providing a video feed to at least one of a client device or a processor based server over a communications network.

In accordance with an exemplary embodiment of the claimed invention, the aforesaid sensor is a carbon dioxide detector for detecting carbon dioxide level and generates an alarm when the detected carbon dioxide level exceeds a predetermined threshold.

In accordance with an exemplary embodiment of the claimed invention, at least one of aforesaid control unit or aforesaid carbon dioxide detector transmits the alarm to at least one of a client device associated a user of the smart stuffed toy or a processor based server over a communications network.

In accordance with an exemplary embodiment of the claimed invention, the aforesaid smart stuffed toy further comprises a client device which communicates with the smart stuffed toy. The client device is at least one of the following: a Bluetooth enabled device, a zig bee protocol enabled device or Wi-Fi enabled device.

In accordance with an exemplary embodiment of the claimed invention, the aforesaid client device is a portable hand held device, a tablet, a smart phone, a personal computer, a laptop or a net book.

In accordance with an exemplary embodiment of the claimed invention, the aforesaid sensor is a carbon dioxide detector for detecting carbon dioxide level. The carbon dioxide detector transmits the detected carbon dioxide level to at least one of the client device or a processor based server. The client device generates an alarm when the detected carbon dioxide level received from the carbon dioxide sensor or the processor based server exceeds a predetermined threshold.

In accordance with an exemplary embodiment of the claimed invention, the aforesaid sensor is a temperature sensor which measures the temperature of the atmospheric environment within the immediate proximity of the smart stuffed toy. The temperature sensor transmits the measured temperature to at least one of the client device or a processor based server. The client device generates an alarm when the measured temperature received from the temperature sensor or the processor based server is outside a predetermined temperature range.

In accordance with an exemplary embodiment of the claimed invention, the aforesaid sensor is at least one of the following: a carbon monoxide detector, a carbon dioxide detector, a smoke detector, a temperature sensor, a humidity sensor, a relative humidity sensor, a motion detector or a sound sensor.

Various other objects, advantages, and features of the claimed invention will become readily apparent from the ensuing detailed description, and the novel features will be particularly pointed out in the appended claims.

BRIEF DESCRIPTION OF THE DRAWINGS

The following detailed description, given by way of example, and not intended to limit the claimed invention solely thereto, will best be understood in conjunction with the accompanying drawings in which:

DETAILED DESCRIPTION OF THE EMBODIMENTS

The claimed invention relates to a smart stuffed toy 1000 with air flow ventilation system 2000. Preferably, the smart stuffed toy 1000 is made of fire-retardant material. In accordance with an aspect of the claimed invention, the smart stuffed toy 1000 is made of hypoallergenic and fire-retardant material. In accordance with an exemplary embodiment of the claimed invention, as shown in FIGS. 1-5, the air flow ventilation or air circulation system 2000 (i.e., fan housing and device control unit 2000) is embedded within the smart stuffed toy 1000. The air flow ventilation system 2000 comprises no blades or soft fan blades to circulate air within close or immediate proximity of an infant or child, such as in a crib, and reduce settlement of $CO_2$. Preferably, the soft fan blades is made of foam or other comparable material that will not cut a child's fingers or toes. Preferably, the air flow ventilation system 2000 provides fresh air through the front surface of the smart stuffed toy 1000 at low volume and at low fan speed. As shown in FIG. 5, the air flow ventilation system 2000 also comprises a battery compartment 2100 accessible via a slit 2200, preferably a zippered slit, formed on a rear surface of the smart stuffed toy 1000. As shown in FIGS. 3 and 5, the air flow ventilation system 2000 can be powered by plugging the power cord 2400 into a power outlet or with batteries removably housed in the battery compartment 2100. The power cord 2400 can be used to directly power the air flow ventilation system 2000 or recharge the rechargeable batteries in the battery compartment 2100.

In accordance with an exemplary embodiment of the claimed invention, the air flow ventilation system 2000 is operable at one speed through a on/off button (not shown) on the surface of the smart stuffed toy 1000, preferably on the rear surface of the smart stuffed toy 1000. Alternatively, the on/off button can be positioned on the battery compartment 2100. In accordance with an exemplary aspect of the claimed invention, the air flow ventilation system 2000 comprises a micro-controller or control unit 5000 to operate the air flow ventilation system (e.g., safe fan blades) at multiple speeds (e.g., slow, medium and fast) through speed selector buttons or a speed dial selector. In accordance with another exemplary aspect of the claimed invention, the air flow ventilation system 2000 can comprise an overheating shutoff device to shut off or power down the air flow ventilation device to prevent overheating and/or a timer to control the operational duration of the air flow ventilation system 2000.

Figure 1:
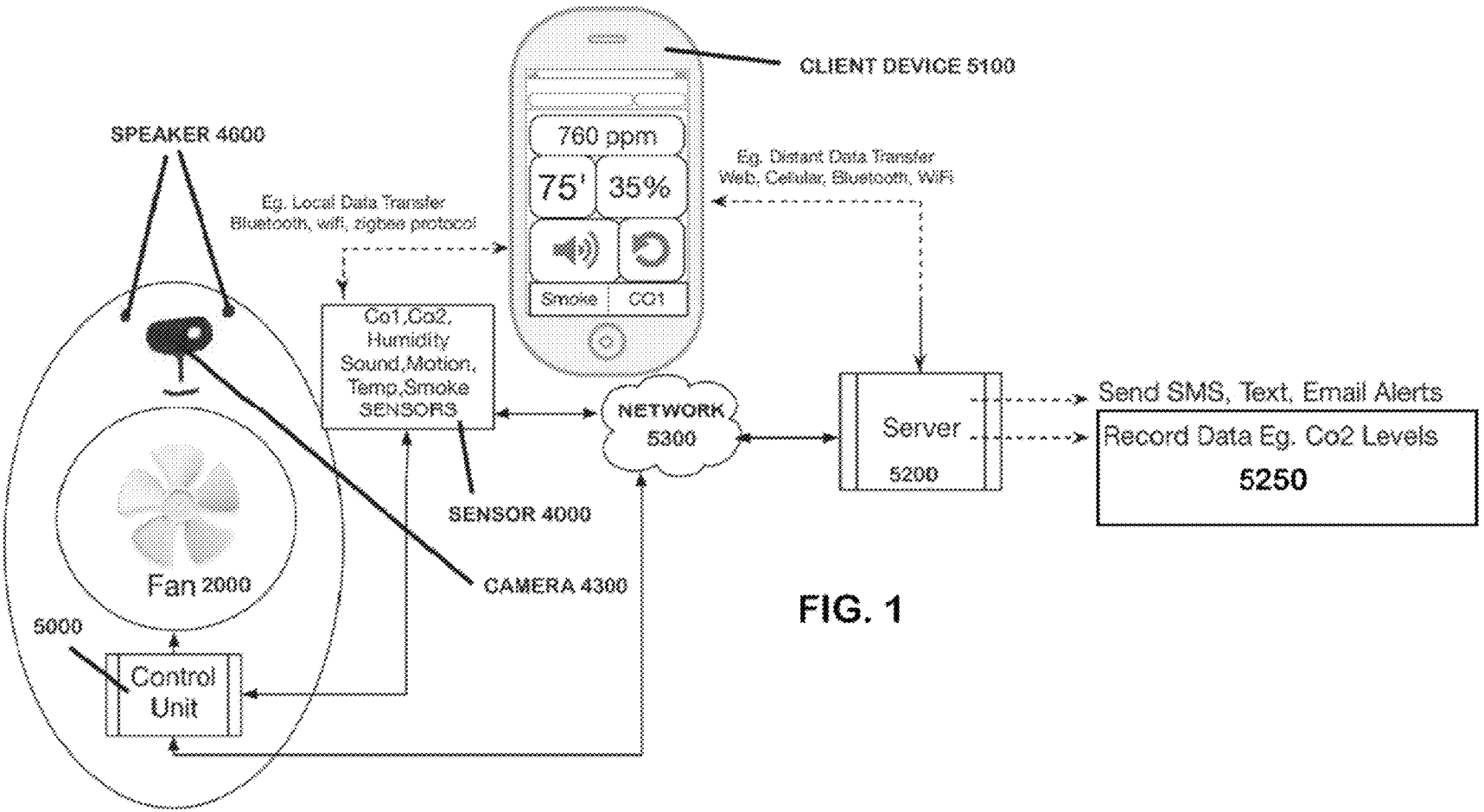
FIG. 1 is a diagram of the system incorporating a smart stuffed toy incorporated in accordance with an exemplary embodiment of the claimed invention.
Figure 2:
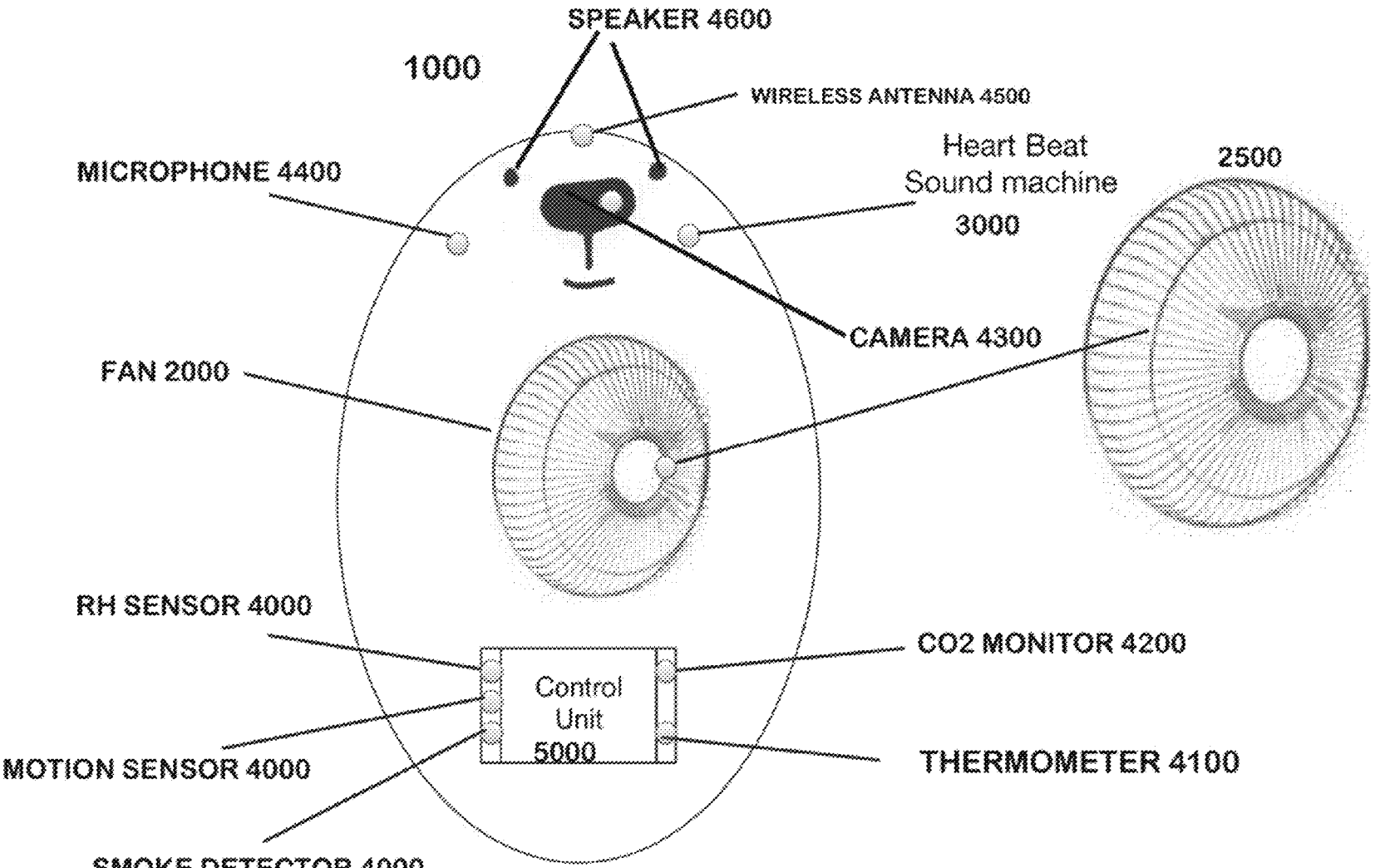
FIG. 2 is a front, perspective view of an egg-shaped smart stuffed toy in accordance with an exemplary embodiment of the claimed invention.
Figure 3:
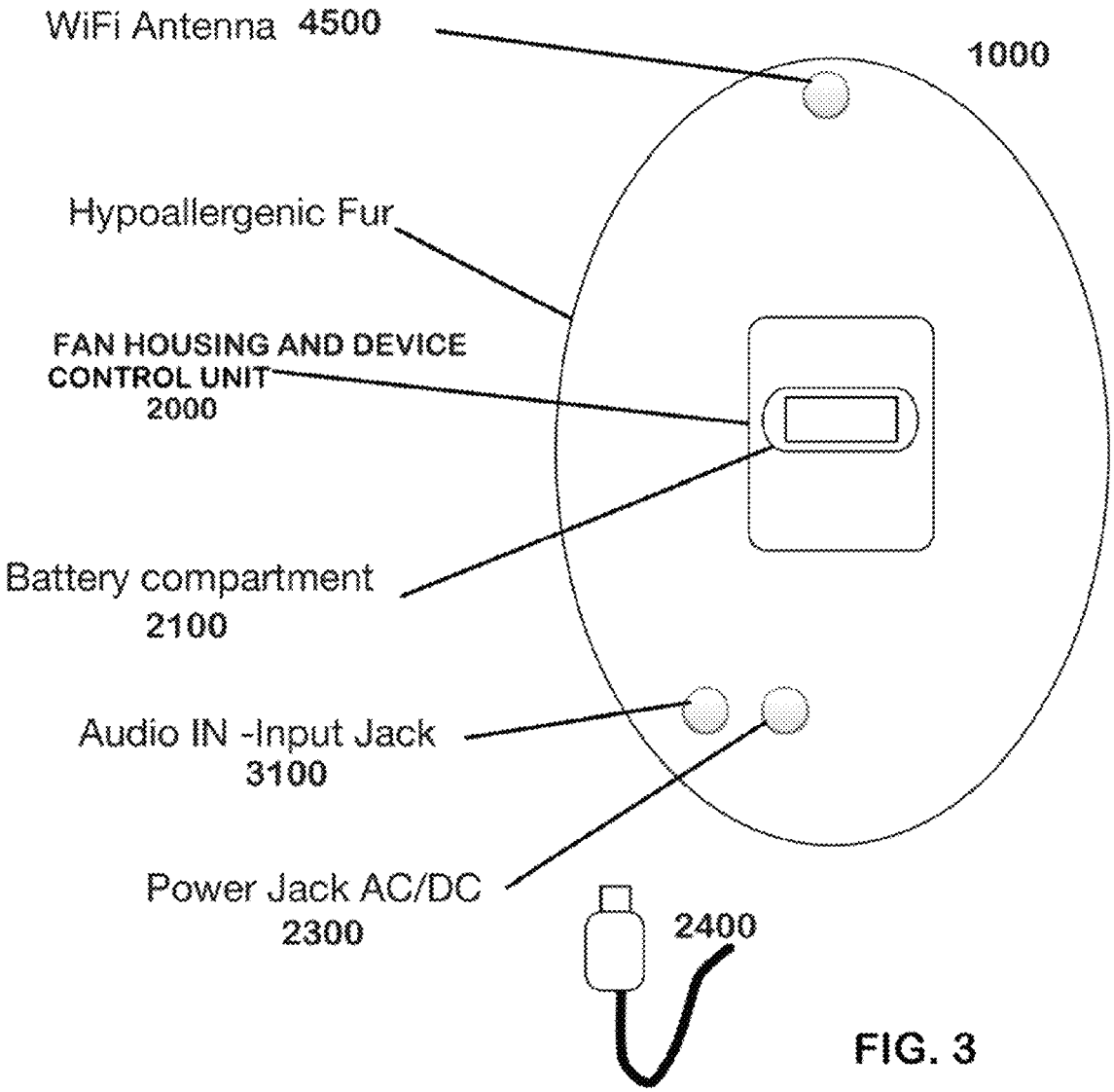
FIG. 3 is a rear, perspective view of the smart stuffed toy of FIG. 2 in accordance with an exemplary embodiment of the claimed invention.
Figure 4:
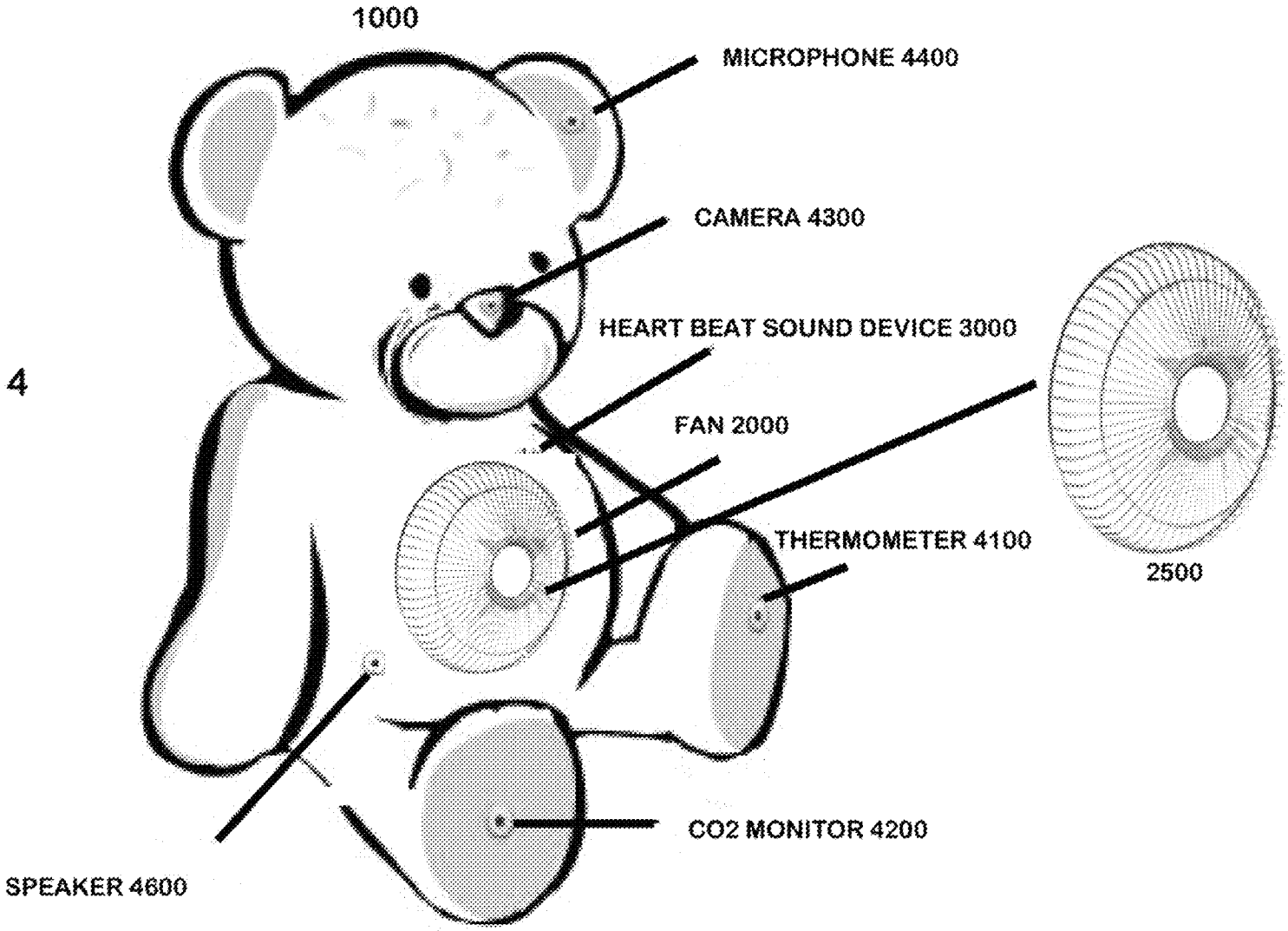
FIG. 4 is a front, perspective view of the smart stuffed toy in accordance with an exemplary embodiment of the claimed invention.
Figure 5:
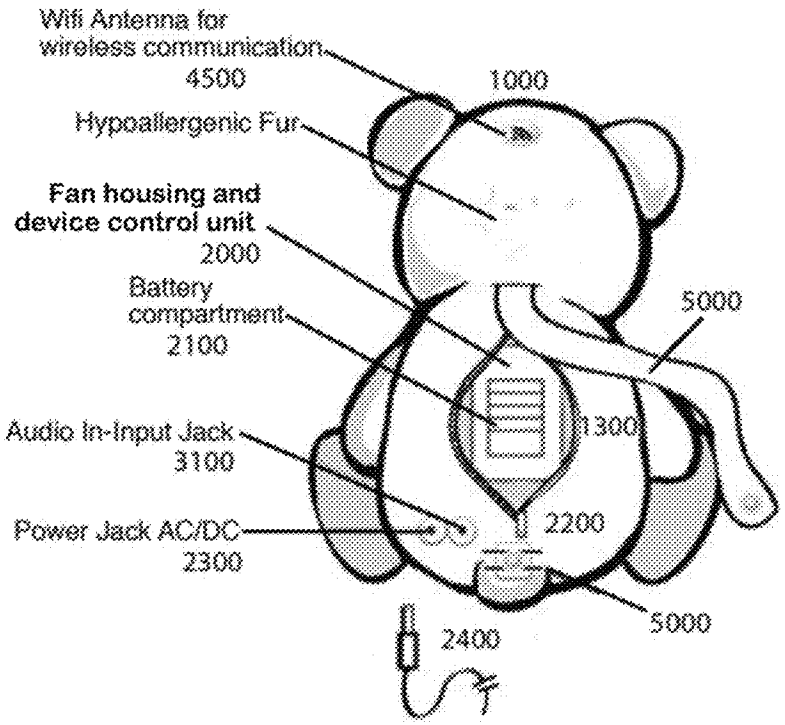
FIG. 5 is a rear, perspective view of the smart stuffed toy of FIG. 4 in accordance with an exemplary embodiment of the claimed invention.

In accordance with an exemplary embodiment of the claimed invention, as shown in FIGS. 2 and 4, the front cover surface 2500 covering the air circulation device or fan 2000 is made of material different from the remaining surfaces of the smart stuffed toy 1000. Preferably, the smart stuffed toy 1000 is made of fire-retardant material and/or hypoallergenic material. The front cover surface 2500 covering air circulation device or fan 2000 is made of air permeable material, such as foam, to provide air flow from the fan 2000 embedded within the smart stuffed toy 1000. Alternatively, the front cover surface 2500 can be made of rubber, plastic, polyvinyl chloride (PVC) with slits/holes to provide air flow from the fan 2000 embedded within the smart stuffed toy 1000.

In accordance with an exemplary embodiment of the claimed invention, the smart stuffed toy 1000 comprises one or more of the following: MP3 player, AM/M radio or a heart beat sound device 3000, preferably biorhythm maternal heart beat sound machine, to provide a soothing and reassuring sound to the baby. Alternatively, the MP3 player, iPod®, AM/FM radio and other comparable audio devices can be connected to the smart stuffed toy via an audio in-input jack 3100 and the audio sound (e.g., music) can be heard through the speaker 4600. iPod® is a registered trademark of Apple Inc. In accordance with an exemplary aspect of the claimed invention, the smart stuffed toy 1000 comprises a night light (not shown), preferably with a detector that turns the night light on when the level of the light falls below a predetermined threshold.

In accordance with an exemplary embodiment of the claimed invention, the smart stuffed toy 1000 comprises one or more of the following sensors 4000: a digital thermometer or temperature sensor 4100 to measure the temperature, a humidity sensor, preferably a relative humidity (RH) sensor 4000, a motion detector 4000, a smoke detector 4000, a carbon monoxide and/or $CO_2$ detector 4200 which sounds an alarm if the carbon monoxide and/or $CO_2$ exceeds a predetermined threshold, an audio/video monitoring device comprising a microphone 4400 and a speaker 4600 for two-way communication and/or a video camera 4300, preferably with a pivot and night-vision capability, to provide a video feed. Preferably, the smart stuffed toy 1000 comprises electronic components to support Wi-Fi® and/or Bluetooth® wireless communications 4500. Wi-Fi® is a registered trademark of Wi-Fi Alliance Corporation and Bluetooth® is a registered trademark of Bluetooth Sig, Inc. It is appreciated that various individual sensors can be combined into one sensor, such as a temperature and humidity sensor. A remote device (not shown), such as a hand held monitor, a PC, a laptop, a net book, a portable digital assistant (PDA), a tablet, a smart phone and like can communicate with the smart stuffed toy via Internet, Wi-Fi, Bluetooth and other comparable wireless communications. Preferably, the remote device is Wi-Fi and/or Bluetooth enabled. In accordance with an aspect of the claimed invention, the sensors 4000 of the smart stuffed toy 1000 transmits video feed, a smoke, carbon monoxide and/or $CO_2$ alarm, audio sound detected by the microphone 4400, temperature reading, motion detection, etc., wirelessly to the remote device, thereby providing a remote monitoring capability.

In accordance with an exemplary embodiment, the control unit 5000 operates and controls the fan 2000 based on the readings received from one or more sensors 4000. The control unit 5000 can turn on/off the fan 2000 or increase/decrease the fan speed based on the readings received from the sensor 4000, That is, the control unit 5000 can increase the fan speed if the sensor reading exceeds a predetermined threshold. For example, the control unit 5000 turns on the fan 2000 if the $CO_2$ reading received from the $CO_2$ sensor 4000 is greater than 700 ppm (parts per million); the control unit 5000 turns off the fan 2000 if the $CO_2$ reading received from the $CO_2$ sensor 4000 is less than 700 ppm; and the control unit 5000 turns the fan 2000 on and transmits an alarm through the speaker 4600 if $CO_1$ is detected by the $CO_1$ sensor 4000. Although the examples are described in conjunction with the $CO_2$ and $CO_1$ sensors/detectors, the control unit 5000 can control the fan 2000 based on the readings from other sensors 4000.

In accordance with an exemplary embodiment of the claimed invention, the control unit 5000 transmits the sensor reading(s) and/or alarm(s) to the client device 5000 within proximity of the smart stuffed toy 1000 (i.e., local data transfer) in form of an SMS, text, and/or an email over a local communications network, such as Bluetooth, Wi-Fi, zigbee protocol and the like. A user can utilize the client device 5000 to set the thresholds for the various sensors 4000, e.g., threshold temperature or threshold $CO_2$ level to activate and/or control the fan 2000.

In accordance with an exemplary embodiment of the claimed invention, the control unit 5000 transmits the sensor reading(s) and/or alarm(s) to the processor-based server 5200 (i.e., distant data transfer) in form of an SMS, text, and/or an email over a communications network 5300, such as Internet (wired and/or wireless), cellular network, Wi-Fi and the like. Alternatively or in addition, the server 5200 receives the sensor reading and alarms directly from the sensors 4000 over the communications network 5300. The server 5200 stores the sensor readings and/or alarms received from the control unit 5000 and/or sensors 4000 in a storage device 5250, e.g., a database, memory and the like. In accordance with an exemplary embodiment of the claimed invention, the server 5200 sends SMS, text and email alerts to the client device 5100, other client devices (e.g., a smart phone, a tablet, a net book, a laptop, a personal computer, a PDA and other communications-enabled devices associated with the user or other users) over the Internet (wired and/or wireless), Wi-Fi, Bluetooth, cellular network. It is appreciated that in an emergency situation, the server 5200 can notify the appropriate authorities (e.g., a police department, hospital, fire department, 911 etc.) via SMS, text, email alerts and the like.

In accordance with an exemplary embodiment of the claimed invention, a user can utilize the client device 5000 to obtain sensor readings and/or to set the thresholds for the various sensors 4000, e.g., threshold temperature or threshold $CO_2$ level to activate and/or control the fan 2000. If the client device 5100 is in close proximity to the smart stuffed toy 1000, then the client device 5100 can communicate directly with the smart stuffed toy 1000 via Wi-Fi, Bluetooth, zigbee protocol and the like. Alternatively or in addition, the client device 5100 can communicate with the smart stuffed toy 1000 using the server 5200 to obtain sensor readings and/or to set the thresholds for the various sensors 4000.

In accordance with an exemplary embodiment of the claimed invention, the microphone 4400, the carbon monoxide and/or $CO_2$ detector 4000, the digital thermometer 4100, the speaker 4600, the AC/DC power jack 2300, the audio in-input jack 3100, and the heart beat sound device 3000 are embedded into the smart stuffed toy 1000.

It is appreciated that the smart stuffed toy 1000 can be any shaped stuffed toy made of soft and plush material, e.g., an egg, a prism, a ball, a cube, a toy, a doll, a teddy bear, a stuffed dog, a stuffed real or cartoon animal and the like. Additionally, the smart stuffed toy 1000 comprises a connecting apparatus or straps 5000 for connecting or strapping the smart stuffed toy 1000 onto a rail of the crib, car seat, and the like.

Various omissions, modifications, substitutions and changes in the forms and details of the device illustrated and in its operation can be made by those skilled in the art without departing in any way from the spirit of the present invention. Accordingly, the scope of the invention is not limited to the foregoing specification, but instead is given by the appended claims along with their full range of equivalents.

What is claimed is:

1. A smart stuffed toy, comprising:

a head, limbs, and a torso portion;

an air flow ventilation device embedded within the torso portion for providing air circulation through a front torso surface of the torso portion covering the air flow ventilation device and the air flow ventilation device is accessible through the torso portion;

at least one sensor for determining an atmospheric environment within an immediate proximity of the smart stuffed toy;

a control unit for controlling the air flow ventilation device based on a sensor reading received from said at least one sensor; and wherein the front torso surface covering the ventilation device is made of material different from remaining surfaces of the smart stuffed toy to permit the air to flow from the ventilation device and through the front torso surface.

2. The smart stuffed toy of claim 1, wherein the front torso surface covering the air flow ventilation device is made of air permeable material.

3. The smart stuffed toy of claim 1, wherein the front torso surface is made of plastic, PVC or rubber with slits or holes to permit air to flow through the front torso surface.

4. The smart stuffed toy of claim 1, wherein the ventilation device comprises no blades.

5. The smart stuffed toy of claim 1, wherein the ventilation device comprises safe fan blades.

6. The smart stuffed toy of claim 1, wherein the control unit turns on the air flow ventilation device when the sensor reading exceeds a predetermined threshold.

7. The smart stuffed toy of claim 1, wherein the control unit turns off the air flow ventilation device when the sensor reading is less than a predetermined threshold.

8. The smart stuffed toy of claim 1, wherein the control unit generates an alarm when the sensor reading exceeds a predetermined threshold.

9. The smart stuffed toy of claim 1, wherein the control unit transmits the sensor reading and an alarm alert to a client device associated with a user of the smart stuffed toy over a communications network.

10. The smart stuffed toy of claim 1, wherein the control unit controls a speed of the air flow ventilation device in accordance with the sensor reading.

11. The smart stuffed toy of claim 10, wherein the control unit increases the speed of the air flow ventilation device when the sensor reading exceeds a predetermined threshold.

12. The smart stuffed toy of claim 10, wherein the control unit decreases the speed of the air flow ventilation device when the sensor reading is below a predetermined threshold.

13. The smart stuffed toy of claim 1, further comprising a video camera for providing a video feed to at least one of a client device or a processor based server over a communications network.

14. The smart stuffed toy of claim 1, wherein said at least one sensor is a carbon dioxide detector for detecting carbon dioxide level and generates an alarm when the detected carbon dioxide level exceeds a predetermined threshold.

15. The smart stuffed toy of claim 14, wherein at least one of control unit or the carbon dioxide detector transmits the alarm to at least one of a client device associated a user of the smart stuffed toy or a processor based server over a communications network.

16. The smart stuffed toy of claim 1, further comprising a client device for communicating with the smart stuffed toy; and wherein the client device is at least one of the following: a Bluetooth enabled device, a zig bee protocol enabled device or Wi-Fi enabled device.

17. The smart stuffed toy of claim 16, wherein the client device is a portable hand held device, a tablet, a smart phone, a personal computer, a laptop or a net book.

18. The smart stuffed toy of claim 16, wherein said at least one sensor is a carbon dioxide detector for detecting carbon dioxide level and transmitting the detected carbon dioxide level to at least one of the client device or a processor based server; and wherein the client device generates an alarm when the detected carbon dioxide level received from the carbon dioxide sensor or the processor based server exceeds a predetermined threshold.

19. The smart stuffed toy of claim 16, wherein said at least one sensor is a temperature sensor for measuring a temperature of the atmospheric environment within an immediate proximity of the smart stuffed toy and transmitting measured temperature to at least one of the client device or a processor based server; and wherein the client device generates an alarm when the measured temperature received from the temperature sensor or the processor based server is outside a predetermined temperature range.

20. The smart stuffed toy of claim 1, wherein said at least one sensor is at least one of the following: a carbon monoxide detector, a carbon dioxide detector, a smoke detector, a temperature sensor, a humidity sensor, a relative humidity sensor, a motion detector or a sound sensor.

* * * * *